US008425703B1

(12) United States Patent
Michienzi et al.

(10) Patent No.: US 8,425,703 B1
(45) Date of Patent: Apr. 23, 2013

(54) INSENSITIVE MUNITIONS PRIMERS

(75) Inventors: Christine Marie Michienzi, White Plains, MD (US); Christine Dianne Knott, White Plains, MD (US)

(73) Assignee: The United States of Amierica as Represented by the Secretary of the Navy, Washington, DC (US)

( * ) Notice: Subject to any disclaimer, the term of this patent is extended or adjusted under 35 U.S.C. 154(b) by 513 days.

(21) Appl. No.: 12/798,165

(22) Filed: Mar. 24, 2010

(51) Int. Cl.

| | |
|---|---|
| ***C06B 45/00*** | (2006.01) |
| ***C06B 33/00*** | (2006.01) |
| ***C06B 33/08*** | (2006.01) |
| ***C06B 33/04*** | (2006.01) |
| ***D03D 23/00*** | (2006.01) |
| ***D03D 43/00*** | (2006.01) |

(52) U.S. Cl.
USPC ..... 149/61; 149/2; 149/37; 149/38; 149/43; 149/109.2; 149/109.4

(58) Field of Classification Search ..... 149/2, 37, 149/38, 43, 61, 109.2, 109.4
See application file for complete search history.

(56) References Cited

U.S. PATENT DOCUMENTS

| | | | | |
|---|---|---|---|---|
| 3,672,301 | A * | 6/1972 | Abbott | 102/530 |
| 5,325,782 | A * | 7/1994 | Strauss et al. | 102/285 |
| 5,482,581 | A | 1/1996 | Urenovitch | |
| 5,492,577 | A * | 2/1996 | Rauber et al. | 149/39 |
| 5,507,893 | A | 4/1996 | Mullay et al. | |
| 5,567,912 | A | 10/1996 | Manning et al. | |
| 6,009,810 | A | 1/2000 | Walsh | |
| 6,117,255 | A * | 9/2000 | Blomquist | 149/36 |
| 6,291,711 | B2 | 9/2001 | Langlet | |
| 7,592,448 | B2 * | 9/2009 | Golding et al. | 540/554 |
| 2001/0007913 | A1 | 7/2001 | Langlet | |
| 2005/0189053 | A1 | 9/2005 | Pile et al. | |
| 2008/0226533 | A1 | 9/2008 | Vorde et al. | |
| 2008/0245252 | A1 * | 10/2008 | Erickson et al. | 102/204 |

FOREIGN PATENT DOCUMENTS

| | | |
|---|---|---|
| JP | PAJ 2001-002488 | 7/1998 |
| JP | PAJ10-197198 | 1/2001 |
| WO | WO9855428 | 12/1998 |
| WO | WO9962846 | 12/1999 |
| WO | WO0127073 | 4/2001 |
| WO | WO2005070823 | 8/2005 |
| WO | WO2006126927 | 11/2006 |
| WO | WO2008001005 | 1/2008 |

OTHER PUBLICATIONS

Lochert, Ian J.,Recent Advanes in the DSTO Evaluation of FOX-7,NDIA Insensitive Munitions & Energetic Materials Technology Symposium, Orlando FL. Mar. 2003.

Stenmark, Helen and Carina Bergvall-Laitala, FOX-7, an IM Ingredient Candidate—Where are we Today?, Insensitive Munitions & Energetic Materials Technology Symposium 2009.

* cited by examiner

*Primary Examiner* — James McDonough
(74) *Attorney, Agent, or Firm* — Fredric J. Zimmerman

(57) ABSTRACT

Embodiments of the invention provide munitions that are optimized for both performance and safety. According to various embodiments of the invention, primers are provided having reduced sensitivity by using less sensitive ingredients. The primer formulations according to embodiments of the invention provide primers that are insensitive to stimulants that tend to cause inappropriate ignition of main propelling charges.

17 Claims, 7 Drawing Sheets

SEPARATED AMMUNITION

(Cross Section on Reference Axis)

FIG. 1(a-b)

FIXED AMMUNITION

SEPARATED AMMUNITION

FIG. 1(c-d)

| Ingredient (wt%) | Formulation | | | | | |
|---|---|---|---|---|---|---|
| | MK 98 | Baseline | PRF11 | PRF12 | PRF71 | PRF72 |
| potassium perchlorate (KP) | 61.90 | | | | | |
| potassium nitrate ($KNO_3$) | | 61.90 | 46.90 | 31.90 | 46.90 | 31.90 |
| n-guanylurea-dinitramide (FOX-12) | | | 15.00 | 30.00 | | |
| 1,1-diamino-2,2-dinitroethene (FOX-7) | | | | | 15.00 | 30.00 |
| nitrocellulose (NC; 12.6% N) | 17.40 | | | | | |
| cellulose acetate butyrate (CAB) | | 12.96 | 12.96 | 12.96 | 12.96 | 12.96 |
| hydroxypropylcellulose (HPC) | | 12.96 | 12.96 | 12.96 | 12.96 | 12.96 |
| trietyleneglycoldinitrate (TEGDN) | 13.70 | | | | | |
| N-methyl-nitratoethyl nitramine (MeNENA) | | 3.11 | 3.11 | 3.11 | 3.11 | 3.11 |
| N-ethyl-2-nitratoethyl nitramine (EtNENA) | | 2.07 | 2.07 | 2.07 | 2.07 | 2.07 |
| Magnesium | 6.40 | 7.00 | 7.00 | 7.00 | 7.00 | 7.00 |
| ethyl centralite (EC) | 0.60 | | | | | |

| Parameter | Formulation | | | | | |
|---|---|---|---|---|---|---|
| | Mk 98 | Baseline | PRF11 | PRF12 | PRF71 | PRF72 |
| Flame Temperature (K) | 3427 | 2698 | 2549 | 2420 | 2656 | 2617 |
| Pressure (MPa) | 142 | 135 | 162 | 187 | 168 | 201 |
| Impetus (J/g) | 616 | 555 | 654 | 741 | 682 | 804 |
| Gas Molecular Weight (g/ mole) | 46.27 | 40.42 | 32.39 | 27.14 | 32.4 | 27.07 |
| Covolume ($cm^3/g$) | 0.584 | 0.673 | 0.802 | 0.925 | 0.802 | 0.924 |
| Ratio of Specific Heats (Cp/Cv) | 1.157 | 1.159 | 1.190 | 1.217 | 1.191 | 1.220 |

FIG. 2

| Parameter | Formulation | | | | | Metric | Reference Materials | |
|---|---|---|---|---|---|---|---|---|
| | Baseline | PRF 11 | PRF 12 | PRF 71 | PRF 72 | | RDX | Mk 98 |
| NOS Impact 50% Height (mm) | >1000 | 851 | 779 | 651 | 167 | ≥398 | 114 | 93 |
| ABL Friction 20 T IL (psig) | >980 | >980 | >980 | 750 | 560 | ≥560 | 135 | >135 |
| ABL ESD 20 T IL (joules) | 0.853 | >0.326 | >0.326 | >0.326 | >0.326 | ≥1.72 | 0.165 | 0.326 |
| DSC Exotherm Peak (Celcius) | 200 | 180 | 180 | 198 | 206 | ≥150 | 235 | 193 |

All formulations less sensitive than MK 98

FIG. 3

| | PRIMB | PRF11 | PRF12 | PRF71 | PRF72 |
|---|---|---|---|---|---|
| Pressure | Burning Rate | | | | |
| 1000 | 0.159 | | 0.132 | 0.175 | 0.192 |
| 3000 | 0.713 | 0.262 | 0.219 | 0.961 | 0.456 |
| 5000 | 0.63 | 0.608 | 0.379 | 1.287 | 0.465 |
| 8000 | 1.128 | | 0.432 | 0.805 | 0.851 |

Pressure (psig)
Rate (inches/second)

FIG. 4A

| Diameter | Formulations | | | | |
|---|---|---|---|---|---|
| | PRIMB (BASELINE) | PRF11 | PRF12 | PRF71 | PRF72 |
| 1 mm (0.039 in) | No Go | No Go | No Go | No Go | No Go |
| 2 mm (0.078 in) | No Go | No Go | No Go | No Go | No Go |
| 3 mm (0.118 in) | No Go | No Go | No Go | No Go | No Go |
| 4 mm (0.157 in) | No Go | No Go | No Go | No Go | No Go |

FIG. 4B

Propellant ignitability testing

INSENSITIVE MUNITIONS PRIMERS

STATEMENT OF GOVERNMENT INTEREST

The embodiments of the invention described herein may be manufactured and used by or for the Government of the United States of America for governmental purposes without the payment of any royalties thereon or therefor.

BACKGROUND

The subject matter described herein relates generally to primers for munitions. Specifically, the subject matter described herein relates to primers for munitions having improved safety features, for example primers for gun charges.

There is continued interest (particularly in the defense industry) in preparing new materials for use in explosives, such as those used in munitions, that have appropriate high-energy properties but also have improved safety profiles. With regard to projectile munitions, improved safety features have long been sought.

By way of background, main propelling charges have been developed having high-energy properties. These charges have advantages that are readily apparent, to with, excellent performance when the main propelling charge is ignited. However, main propelling charges with high sensitivity have significant drawbacks, including at least decreased safety with respect to inappropriate ignition of the main propelling charge (such as untimely ignition of the main propelling charge due to, for example, unplanned stimuli including for example inappropriate application of heat, fragment strikes, et cetera).

Such safety concerns drove approaches to improve the safety of munitions. Previous approaches have focused efforts on modification of the main propelling charge to make the main propelling charge less sensitive to ignition via unplanned stimuli. In this regard, improvements have been obtained in the area of decreasing the sensitivity of the main propelling charge. This approach has also lead to a scenario where it has been viewed as desirable, if not necessary, to increase the sensitivity of the priming charge such that the decreased sensitivity main propelling charge properly ignites.

SUMMARY

Embodiments of the invention provide munitions that are optimized for both performance and safety. According to various embodiments of the invention, primer compositions are provided which have reduced sensitivity to unplanned stimuli by selectively incorporating less sensitive ingredients. The primer formulations according to embodiments of the invention provide primers that are insensitive to unplanned stimuli that tend to cause inappropriate ignition of main propelling charges, yet retain an adequate capability to ignite a main propelling charge.

In summary, one aspect of the invention provides a device including one or more primers comprising a reduced sensitivity priming composition resistant to ignition via an unplanned stimulus.

Another aspect of the invention provides a method including forming one or more primers comprising a reduced sensitivity priming composition resistant to ignition via an unplanned stimulus; and disposing the one or more primers in a casing configured to contain a main propelling charge therein.

A further aspect of the invention provides a device including one or more primers; and a casing; the casing having a main propellant disposed therein which substantially surrounds the one or more primers; and the one or more primers comprising a priming composition, the priming composition including: potassium nitrate; one or more of n-guanylurea-dinitramide and 1,1-diamino-2,2-dinitroethene; cellulose acetate butyrate; hydroxypropylcellulose; N-methyl-nitratoethyl nitramine; N-ethyl-2-nitratoethyl nitramine; and magnesium.

For a better understanding of the embodiments of the invention, together with other and further features and advantages thereof, reference is made to the following description, taken in conjunction with the accompanying drawings, and the scope of the claimed embodiments of the invention will be pointed out in the appended claims.

BRIEF DESCRIPTION OF THE FIGURES

FIG. 2 illustrates exemplary primer formulations and their thermochemical properties according to embodiments of the invention contrasted with reference materials.

FIG. 3 illustrates small-scale sensitivity parameters of exemplary primer formulations according to embodiments of the invention contrasted with reference materials.

FIG. 4 A illustrates performance parameters of exemplary primer formulations according to embodiments of the invention contrasted with reference materials.

FIG. 4B illustrates shock sensitivity parameters of exemplary primer formulations according to embodiments of the invention contrasted with a reference material.

DETAILED DESCRIPTION OF EXEMPLARY EMBODIMENTS OF THE INVENTION

Figures 1A, 1B:
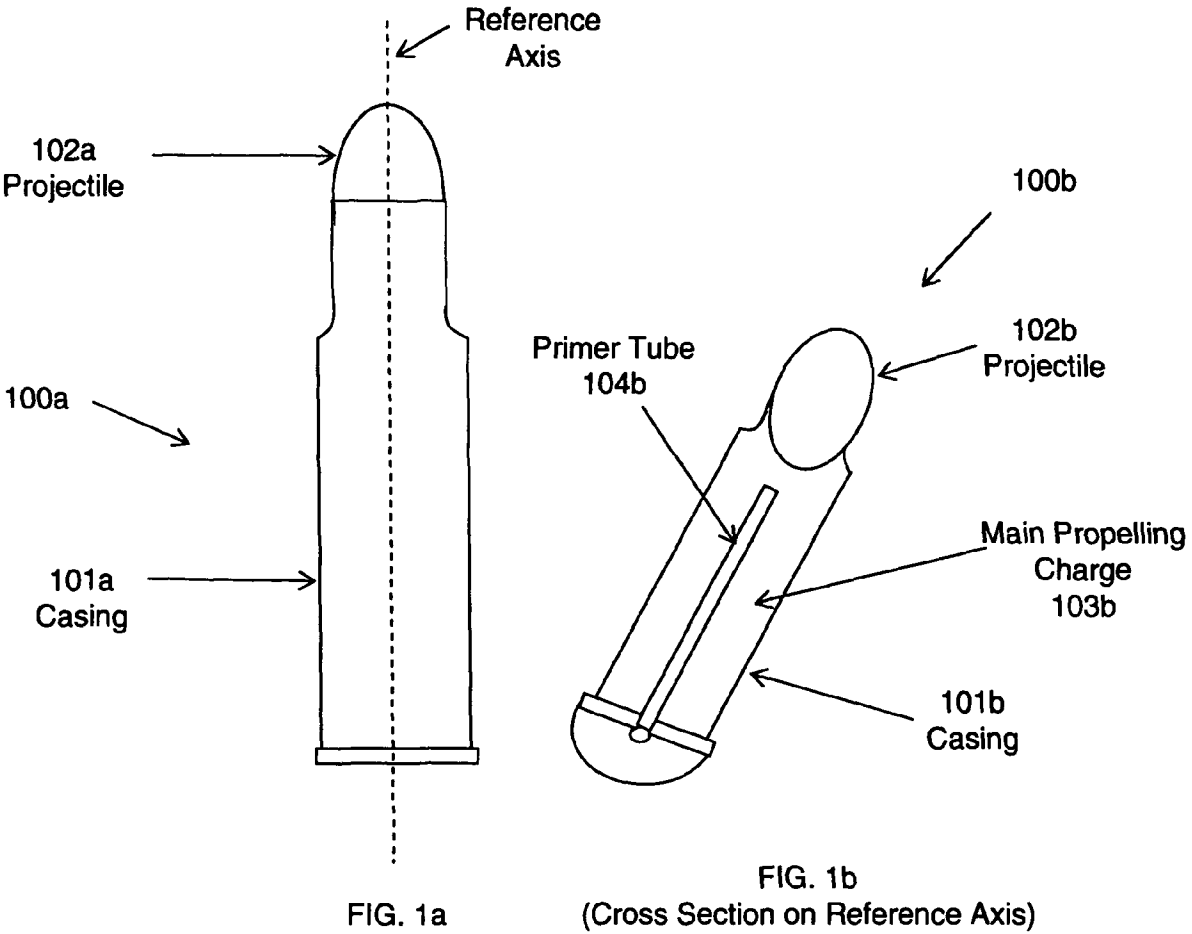
FIG. 1(*a-d*) illustrates various types of ammunition configurations.

It will be readily understood that the components of the embodiments of the invention, as generally described and illustrated in the figures herein, may be arranged and designed in a wide variety of different configurations in addition to the described exemplary embodiments. Thus, the following more detailed description of the embodiments of the invention, as represented in the figures, is not intended to limit the scope of the embodiments of the invention, as claimed, but is merely representative of exemplary embodiments of the invention.

Reference throughout this specification to "one embodiment" or "an embodiment" (or the like) means that a particular feature, structure, or characteristic described in connection with the embodiment is included in at least one embodiment of the invention. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments of the invention. One skilled in the relevant art will recognize, however, that aspects of the invention can be practiced without one or more of the specific details, or with other methods, components, materials, et cetera. In other instances, well-known structures, materials, or operations are not shown or described in detail to avoid obscuring aspects of the invention.

As noted herein, previous approaches to making munitions more insensitive to unplanned stimuli and thus resistant to premature/unplanned discharge/explosion have focused efforts on modification of the main propelling charge. Unplanned stimuli can include but are not limited to a direct fire (fast cook off), a nearby heat source (slow cook off), bullet/fragment strikes and the like.

The response of munitions to unplanned stimuli can be generalized on a scale of Response Types. Response Types I through VI are often utilized, where Types I/II correspond to detonation and partial detonation, respectively; Type III corresponds to explosion, Type IV corresponds to deflagration/propulsion, Type V corresponds to burning, and Type VI corresponds to no sustained reaction. Prior approaches to obtaining a favorable response, that is, Type VI, have generally focused on making the main propelling charge insensitive to unplanned stimuli. Importantly, previous approaches generally incorporated primers that were designed to optimize ignition of main propelling charges, particularly the insensitive main propelling charges that have been developed to achieve increased safety.

The inventors have discovered, however, that primer sensitivity to unplanned stimuli importantly impacts the overall safety profile of the munitions. Particularly, the inventors have recognized that conventional assumptions regarding primers and priming charges were incorrect. These incorrect assumptions regarding primers and priming charges (and the insensitive munitions (IM) response) can be summarized as: 1) the response of the main propelling charge was worse than the response for the priming charge; and 2) that the response of the priming charge did not significantly contribute to the overall response.

The inventors have conducted testing indicating that indeed the response of the primer to unplanned stimuli significantly impacts the response of munitions to unplanned stimuli. In fact, the response of the primer to unplanned stimuli tends to drive the response of the main propellant. Moreover, with the advent of insensitive main propelling charges, the contribution of the primer to the IM response is increased. Therefore, the inventors have recognized a need for primers with decreased sensitivity if IM compliance of main propelling charges is to be achieved.

By way of non-limiting example, the inventors have discovered during testing that the response to a fragment impact test on a decreased sensitivity main propelling charge was no response (Type VI) when the primer was not struck. A decreased sensitivity main propelling charge includes for example a main propelling charge conventionally referred to as a low vulnerability main propelling charge (LOVA), which is generally regarded as a difficult to ignite main propellant requiring appropriate temperature, oxygen, pressure and hot particles. However, in a re-test of fragment impact, where the primer was struck, an explosion reaction (Type III) resulted.

Accordingly, embodiments of the invention provide munitions that are optimized for both performance and safety. A priming charge formulation generally includes a binder, which comprises a polymer and a plasticizer, and one or more solids. According to various embodiments of the invention, priming charge formulations are provided which have reduced sensitivity to unplanned stimuli because one or more of the binder and the solid(s) have been modified. Embodiments of the invention provide priming charges that include one or more of potassium nitrate ($KNO_3$), n-guanylurea-dinitramide (so called "FOX-12"), 1,1-diamino-2,2-dinitroethene (so called "FOX-7"), cellulose acetate butyrate (CAB), hydroxypropylcellulose (HPC), N-methyl-nitratoethyl nitramine (MeNENA), N-ethyl-2-nitratoethyl nitramine (EtNENA), and magnesium.

Described in detail herein are several representative and exemplary primer re-formulations (PRFs) of priming charges consistent with embodiments of the invention, as claimed. Overall, the PRFs are designed to achieve decreased primer sensitivity to unplanned stimuli (compared to conventional primer formulations such as MK 98) while retaining certain positive aspects of conventional primer formulations (for example, the ability to adequately ignite the main propellant/charge).

The illustrated embodiments of the invention will be best understood by reference to the figures. While the figures illustrate representative examples, the following description is intended only by way of example, and simply illustrates certain exemplary embodiments of the invention as claimed herein.

Figures 1C, 1D:
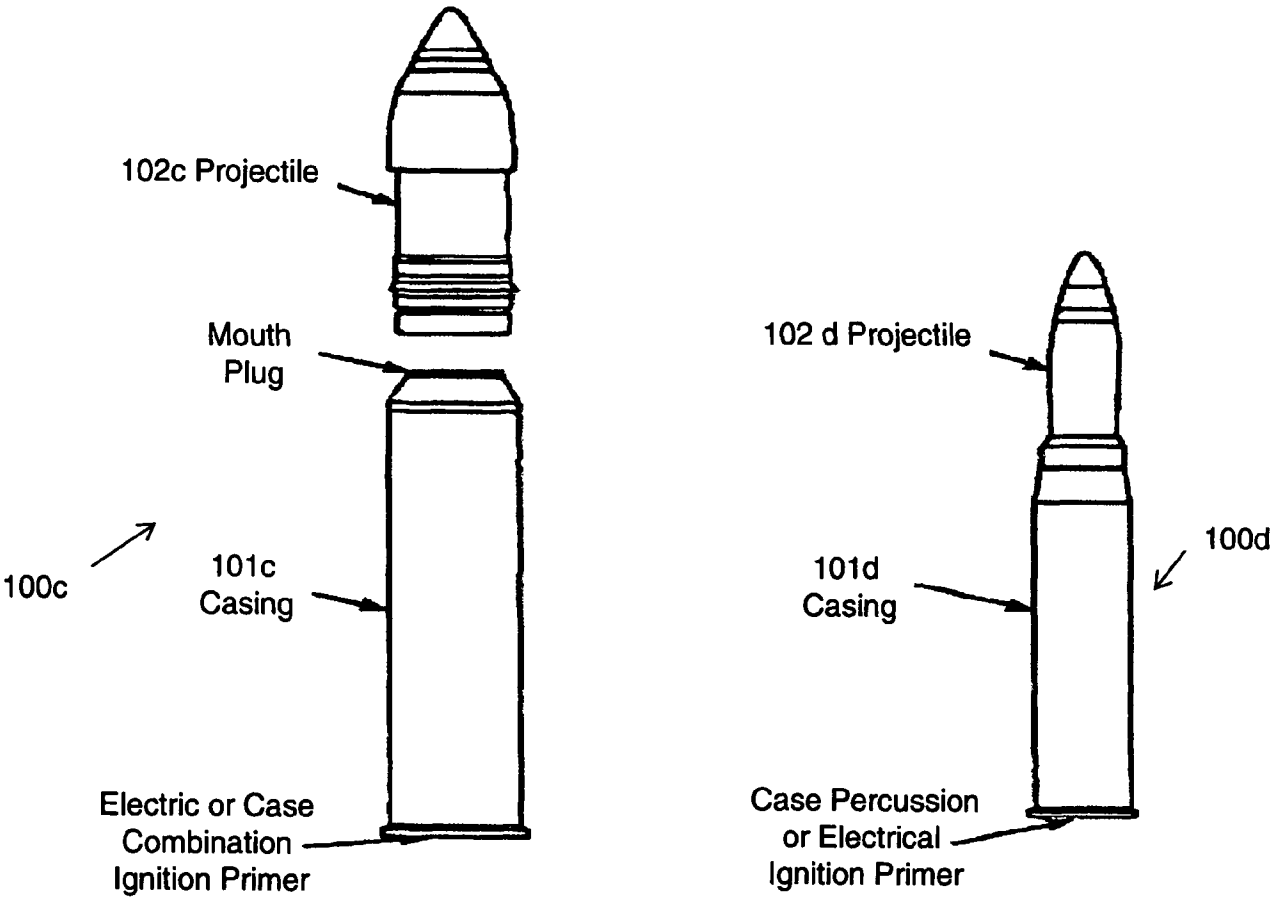

Referring to FIG. 1(*a-d*), exemplary configurations of munitions are illustrated. As shown, the overall configuration of the ammunition 100 (*a-d*) includes a casing 101 (*a-d*) configured to house the main propelling charge 103*b* and the priming charge (which is contained in a primer, such as a primer tube 104*b*). The casing 101 (*a-b* and *d*) can interface with a projectile 102 (*a-b* and *d*), forming an enclosure housing the propellants. However, munitions can take any of a variety of forms, such as that of a separated ammunition 100*c*, in which case the projectile 102*c* is separately loaded from the casing 101*c* housing the main propelling charge. As such, a mouth plug can be included at the "top" end of the casing 101*c* which is adjacent to the projectile 102*c*, rather than a direct interface between the casing and projectile (as represented in FIG. 101 (*a-b* and *d*).

For ease of discussion, a reference axis is included in FIG. 1*a*, which corresponds to the cross-sectional view shown in FIG. 1*b*. The propellants may take the form of a main propelling charge 103*b* substantially surrounding a primer tube 104*b*. The primer tube 104*b* contains a primer propellant/priming charge. It should be noted, however, that the main propelling charge and the priming charge can be configured in any of a variety of ways such that the priming charge, when ignited, properly ignites the main propelling charge. Thus, an electric or percussion primer may be used, as illustrated in FIG. 1 (*c-d*). It should also be noted that in some ammunition, particularly large-scale, separated ammunition 100*c*, an additional charge is often included in the projectile itself.

Referring to FIG. 2, illustrated in tabular format are several exemplary PRFs (PRF 11, PRF 12, PRF 71, PRF 72) according to embodiments of the invention, contrasted with a conventional primer formulation (MK 98) know to easily ignite a LOVA main propelling charge. It should be particularly noted that the weight percentages of the PRFs illustrated in the figures throughout are given as non-limiting examples.

MK 98 includes (in weight percent (%)) about 61.90% potassium perchlorate (KP), about 17.40% nitrocellulose (NC), about 13.70% trietyleneglycoldinitrate (TEGDN), about 6.40% magnesium, and about 0.60% ethyl centralite (EC). A baseline primer formulation is included in FIG. 2 for reference, the baseline formulation includes (in weight percent (%)) about 61.90% potassium nitrate ($KNO_3$), about 12.96% cellulose acetate butyrate (CAB), about 12.96% hydroxypropylcellulose (HPC), about 3.11% N-methyl-nitratoethyl nitramine (MeNENA), about 2.07% N-ethyl-2-nitratoethyl nitramine (EtNENA), and about 7.00% magnesium.

As shown, the PRFs according to embodiments of the invention include a priming charge having a combination of one or more of the following ingredients: potassium nitrate ($KNO_3$), n-guanylurea-dinitramide ("FOX-12"), 1,1-diamino-2,2-dinitroethene ("FOX-7"), cellulose acetate butyrate (CAB), hydroxypropylcellulose (HPC), N-methyl-nitratoethyl nitramine (MeNENA), N-ethyl-2-nitratoethyl nitramine (EtNENA), and magnesium.

As shown in FIG. 2, an exemplary embodiment of the invention provides a PRF (PRF 11) that includes (in weight percent (%)): about 46.90% potassium nitrate (KNO); about 15.00% n-guanylurea-dinitramide (FOX-12); about 12.96% cellulose acetate butyrate (CAB); about 12.96% hydroxypropylcellulose (HPC); about 3.11% MeNENA; about 2.07% EtNENA; and about 7.00% magnesium.

Another exemplary embodiment of the invention provides a PRF (PRF 12) that includes (in weight percent (%)): about 31.90% potassium nitrate (KNO); about 30.00% n-guanylurea-dinitramide (FOX-12); about 12.96% cellulose acetate butyrate (CAB); about 12.96% hydroxypropylcellulose (HPC); 3.11% MeNENA; about 2.07% EtNENA; and about 7.00% magnesium.

Another exemplary embodiment of the invention provides a PRF (PRF 71) that includes (in weight percent (%)): about 46.90% potassium nitrate (KNO); about 15.00% 1,1-diamino-2,2-dinitroethene (FOX-7); about 12.96% cellulose acetate butyrate (CAB); about 12.96% hydroxypropylcellulose (HPC); about 3.11% MeNENA; about 2.07% EtNENA; and about 7.00% magnesium.

Another exemplary embodiment of the invention provides a PRF (PRF 72) that includes (in weight percent (%)): about 31.90% potassium nitrate (KNO); about 30.00% 1,1-diamino-2,2-dinitroethene (FOX-7); about 12.96% cellulose acetate butyrate (CAB); about 12.96% hydroxypropylcellulose (HPC); about 3.11% MeNENA; about 2.07% EtNENA; and about 7.00% magnesium.

Also presented in FIG. 2 are calculated flame temperature (K), pressure (MPa), impetus (J/g), gas molecular weight (g/mole), co-volume ($cm^3/g$), and ratio of specific heats for MK 98, the baseline formulation, and the exemplary PRFs according to embodiments of the invention. As illustrated in FIG. 2, the PRFs demonstrate favorable parameters inasmuch as the flame temperature is high enough to ignite the main propelling charge, but is not so high as to damage the overall casing, the pressure is adequately high, and the molecular weight (MW) of the gases is adequately low.

Referring now to FIG. 3, small-scale sensitivity parameters of exemplary primer formulations according to embodiments of the invention contrasted with reference materials. As shown, the NOS (naval ordinance station) impact (50% height in mm), the ABL (Allegheny Ballistics Laboratory) friction (20 T 1L (psig), ABL ESD (electrostatic discharge) 20 T 1L (joules), and DSC (differential scanning calorimetery) Exotherm Peak (degrees Celsius) are shown. All PRFs were found to be less sensitive to unplanned stimuli than standard primer formulations (here, MK 98 and RDX). As illustrated in FIG. 3, the small-scale sensitivity of the PRFs is reduced (the higher the number, the less sensitive the PRF).

Referring now to FIG. 4A, the burning rate of the baseline (PRIMB) is contrasted with the PRFs according to embodiments of the invention. As illustrated in FIG. 4A, the burn rate of the PRFs at various pressures are illustrated, which are useful in determining the appropriate geometry of the primer charge material in order to meet manufacturing requirements.

In FIG. 4B are shown critical diameter test results (shock sensitivity test/tool) of PRFs according to embodiments of the invention, contrasted with the baseline (PRIMB). As shown, all of the PRFs according to embodiments of the invention failed to detonate, illustrating that they are very insensitive to unplanned stimuli.

Figure 5:
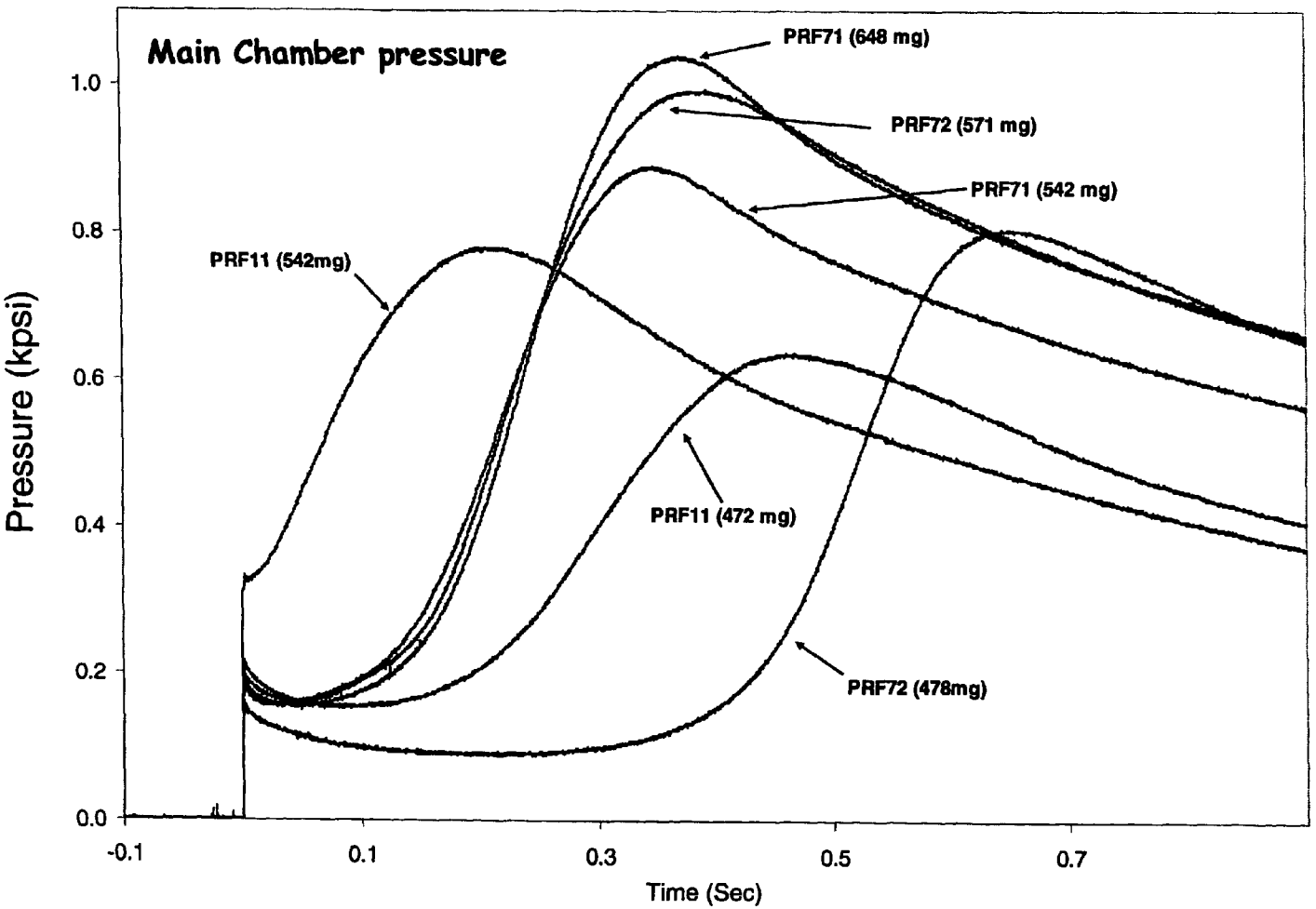
FIG. 5 illustrates performance parameters of exemplary primer formulations according to embodiments of the invention.

Turning now to FIG. 5, main propellant ignitability testing results for PRFs according to embodiments of the invention are illustrated. As illustrated, the main chamber pressure (kpsi) as a function of time (seconds) increases in response to ignition of the priming charge commensurate with adequate ignition of the main propelling charge. These results confirm that the exemplary PRFs illustrated herein are capable of properly igniting the main propelling charge.

As described herein, primer propellants according to embodiments of the invention have reduced sensitivity by avoiding conventionally used primer propellant ingredients. For example, nitrocellulose is removed as a primer propellant ingredient according to embodiments of the invention and is replaced with less sensitive ingredients, for example CAB and HPC are binder polymers used according to embodiments of the invention. MeNENA and EtNENA are binder plasticizers used according to embodiments of the invention, and FOX 7 and FOX 12 are solids used according to embodiments of the invention.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

In the figures and specification, there has been set forth exemplary embodiments of the invention and, although specific terms are used, the description thus given uses terminology in a generic and descriptive sense only and not for purposes of limitation.

Finally, any numerical parameters set forth in the specification and attached claims are approximations (for example, by using the term "about") that may vary depending upon the desired properties sought to be obtained by the embodiments of the present invention. At the very least, and not as an attempt to limit the application of the doctrine of equivalents to the scope of the claims, each numerical parameter should at least be construed in light of the number of significant digits and by applying ordinary rounding.

What is claimed is:

1. A device, comprising:

at least one primer comprising a priming composition being resistant to ignition via an unplanned stimulus, wherein the priming composition further comprises at least one of a binder component and a solid component, wherein the binder component comprises a plasticizer, and wherein the plasticizer is selected from at least one of N-methyl-nitratoethyl nitramine and N-ethyl-2-nitratoethyl nitramine.

2. The device according to claim 1 wherein the binder component further comprises a polymer.

3. The device according to claim 1 wherein the solid component is selected from at least one of n-guanylurea-dinatramide, and 1,1-diamino-2,2-dintroethene.

4. The device according to claim 1 wherein the binder component further comprises a polymer, and wherein the polymer is selected from at least one of cellulose acetate butyrate and hydroxypropylcellulose.

5. The device according to claim 1, wherein the priming composition includes at least one of potassium nitrate; n-guanylurea-dinitramide; cellulose acetate butyrate; hydroxypropylcellulose; N-methyl-nitratoethyl nitramine; N-ethyl-2-nitratoethyl nitramine; and magnesium.

6. The device according to claim 1, wherein the priming composition includes at least one of potassium nitrate; 1,1-diamino-2,2-dinitroethene; cellulose acetate butyrate; hydroxypropylcellulose; N-methyl-nitratoethyl nitramine; N-ethyl-2-nitratoethyl nitramine; and magnesium.

7. The device, according to claim 1, wherein the priming composition comprises:

between 30 to 50 percent weight potassium nitrate;

between 15 to 30 percent weight 1,1-diamino-2,2-dinitroethene;

between 10 to 15 percent weight cellulose acetate butyrate;

between 10 to 15 percent weight hydroxypropylcellulose;

between 2 to 4 percent weight N-methyl-nitratoethyl nitramine;

between 1 to 3 percent weight N-ethyl-2-nitratoethyl nitramine; and between 5 to 9 percent weight magnesium.

8. The device according to claim 1, wherein the binder component further comprises a polymer, and wherein the priming composition comprises:

between 30 to 50 percent weight potassium nitrate;

between 15 to 30 percent weight n-guanylurea-dinitramide;

between 10 to 15 percent weight cellulose acetate butyrate;

between 10 to 15 percent weight hydroxypropylcellulose;

between 2 to 4 percent weight N-methyl-nitratoethyl nitramine;

between 1 to 3 percent weight N-ethyl-2-nitratoethyl nitramine; and between 5 to 9 percent weight magnesium.

9. The device according to claim 1, further comprising a main propelling charge.

10. A method, comprising:

forming at least one primer comprising a reduced sensitivity priming composition resistant to ignition via an unplanned stimulus; and disposing said at least one primer in a casing being configured to contain a main propelling charge therein, wherein the priming composition further comprises at least one of a binder componenet and a solid component, wherein the binder component comprises a plasticizer, and wherein the plasticizer is selected from at least one of N-methyl-nitratoethy nitramine and N-ethyl-2-nitraoethyl nitramine.

11. The method according to claim 10, wherein the reduced sensitivity priming composition resistant to ignition via an unpalnned stimulus further comprises at least one of a binder component having reduced sensitivity to ignition via an unplanned stimulus, and a solid component having reduced sensitivity to ignition via an unplanned stimulus.

12. The method according to claim 11, wherein the binder component further comprises a polymer having reduced sensitivity to ignition via an unplanned stimulus; and a plasticizer having reduces sensitivity to ignirion via an unplanned stimulus.

13. The method according to claim 11, wherein the solid component comprises at least one of n-guanylurea-dinatramide; and 1, 1-diamino-2, 2-dintroethene, wherein the polymer comprises at least one of cellulose acetate butyrate and hydroxypropylcellulose.

14. The method according to claim 10, wherein the reduced sensitivity priming composition resistant to ignition via an unplanned stimulus comprises:

potassium nitrate;

at least one of n-guanylurea-dinitramide and 1, 1-diamino-2, 2-dinitroethene;

cellulose acetate butyrate;

hydroxypropylcellulose;

N-methyl-nitratoethyl nitramine;

N-ethyl-2-nitratoethyl nitramine; and magnesium.

15. The method according to claim 10, wherein the reduced sensitivity priming composition resistant to ignition via an unplanned stimulus comprises:

between 30 to 50 percent weight potassium nitrate;

between 15 to 30 percent weight 1, 1-diamino-2, 2-dinitrothene;

between 10 to 15 percent weight cellulose acetate butyrate;

between 10 to 15 percent weight hydroxypropylcellulose;

between 2 to 4 percent weight N-methyl-nitratoethyl nitramine;

between 1 to 3 percent weight N-ethyl-2-nitratoethyl nitramine; and between 5 to 9 percent weight magnesium.

16. The method according to claim 10, wherein the reduced sensitivity priming composition resistant to ignition via an unplanned stimulus comprises:

between 30 to 50 percent weight potassium nitrate;

between 15 to 30 percent weight n-guanylurea-dinitramide;

between 10 to 15 percent weight cellulose acetate butyrate;

between 10 to 15 percent weight hydroxypropylcellulose;

between 2 to 4 percent weight N-methyl-nitratoethyl nitramine;

between 1 to 3 percent weight N-ethyl-2-nitratoethyl nitramine; and between 5 to 9 percent weight magnesium.

17. A device, comprising:

at least one primer; and a casing;

the casing having a main propellant disposed therein which substantially surrounds said at least one primer; and said at lease one primer comprising a priming composition, the priming composition including:

potassium nitrate;

at least one of n-guanylurea-dinitramide and 1, 1-diamino-2, 2-dinitroethene;

cellulose acetate butyrate;

hydroxypropylcellulose;

N-methyl-nitratoethyl nitramine;

N-ethyl-2-nitratoethyl nitramine; and magnesium.

* * * * *